United States Patent [19]

Braendel et al.

[11] Patent Number: 4,881,353

[45] Date of Patent: Nov. 21, 1989

[54] CUBICLE

[75] Inventors: Gregory G. Braendel, Los Angeles, Calif.; David M. Goodwin, Pyrford, England; Brian J. Moore, Wirral, United Kingdom

[73] Assignee: Braendel & Associates, Inc., Sun Valley, Calif.

[21] Appl. No.: 40,893

[22] Filed: Apr. 21, 1987

[51] Int. Cl.[4] ..... E04H 1/2

[52] U.S. Cl. ..... 52/239; 52/34; 52/36; 52/126.4; 52/126.7; 49/237

[58] Field of Search ..... 52/29, 32, 34, 35, 36, 52/239, 126.1, 126.3, 126.4, 126.6, 126.7, 243.1, 238.1; 49/237, 238, 239

[56] References Cited

U.S. PATENT DOCUMENTS

| | | | |
|---|---|---|---|
| 893,022 | 7/1908 | Siedle | 49/238 |
| 2,881,876 | 4/1959 | Williams | 52/126.4 |
| 3,108,664 | 10/1963 | Vawter | 52/239 X |
| 3,194,362 | 7/1965 | Wargo | 52/126.4 |
| 3,398,487 | 8/1968 | Matuas | 49/239 |
| 3,570,200 | 3/1971 | Ritner | 52/126.4 |
| 4,388,783 | 6/1983 | Logie | 52/36 |

FOREIGN PATENT DOCUMENTS

| | | | |
|---|---|---|---|
| 607446 | 8/1948 | United Kingdom | 49/237 |

*Primary Examiner*—David A. Scherbel
*Assistant Examiner*—Richard E. Chilcot, Jr.
*Attorney, Agent, or Firm*—Nemschoff & Supnik

[57] ABSTRACT

A toilet cubicle having a pair of post engaging side panels bracketed to a rear wall and a top headrail engaging the side panels have doors rotatably joined in spaced apart relationship to the posts. Each door is pivotally supported by a foot disposed in spaced relationship to the posts. The feet have a threaded insert supporting base receiving an adjustably threaded member, and a gravity hinge and door pivot supporting cap engaging the opposite end of the threaded member. A nut on the threaded member is movable to engage an upper surface of the base. The nut has a transverse thread for receiving a tapered end set screw to destructively engage the threads of the threaded member and fix the nominally open positioning of the door, and resist travel thereafter. The gravity hinge has a bottom portion engaging the cap and an upwardly extending annular portion truncated at an oblique angle about a bore aperture of the cap, and an upper portion having a downwardly extending obliquely truncated annular portion matable with that of the upwardly extending portion. The feet are adjustable, by rotation of the cap with respect to the base, yet may be rigidly fixed to prevent further travel, and thus prevent the door of the cubicle from loosening and falling from its pivotal couplings.

17 Claims, 5 Drawing Sheets

FIG. 1
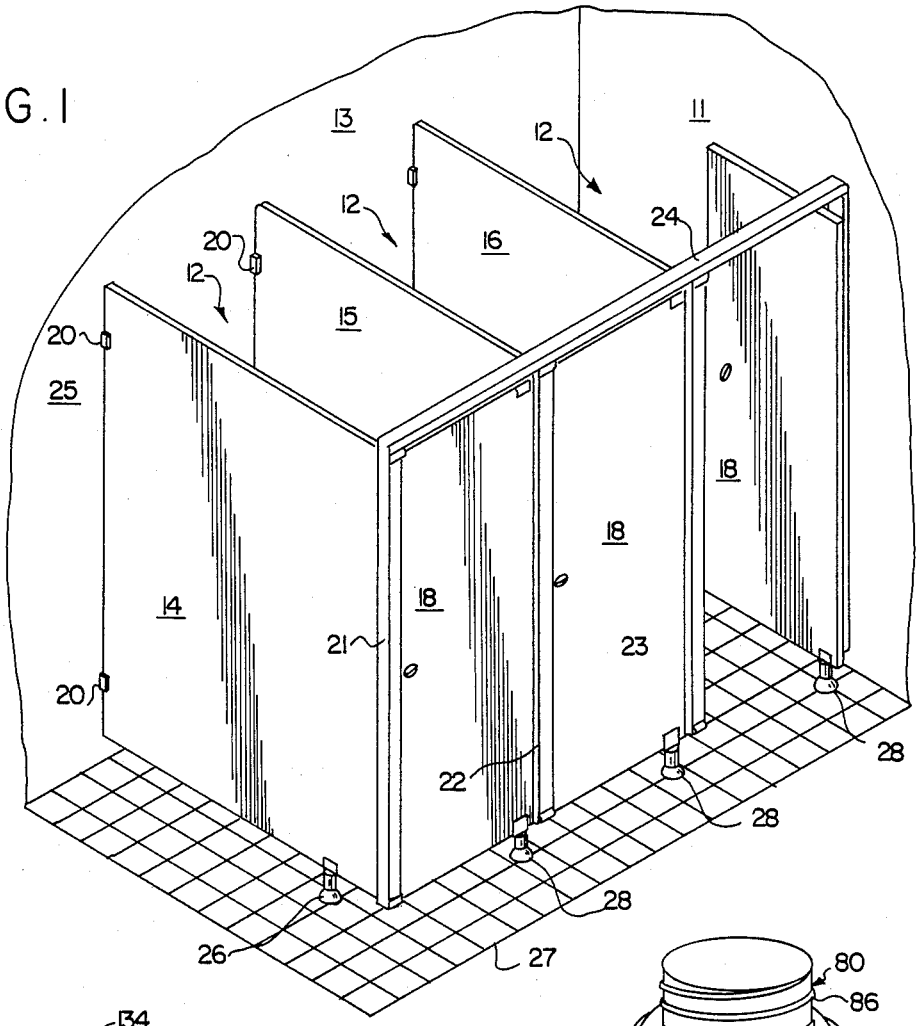
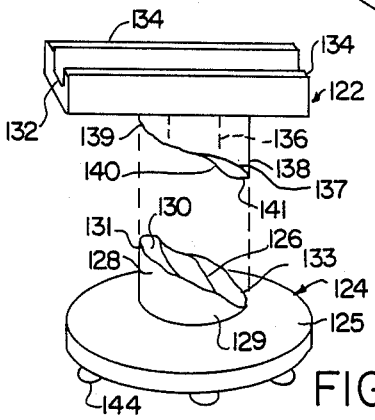
FIG. 7
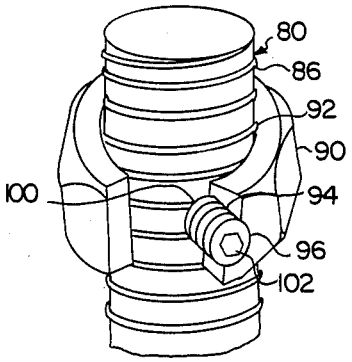
FIG. 8

CUBICLE

FIELD OF THE INVENTION

This invention pertains to cubicle construction for adjacent toilet cubicles. More particularly, the invention pertains to toilet cubicle support arrangements.

BACKGROUND OF THE INVENTION

Typical cubicle constructions have a rear partition fastened to an exiting wall. The partition at the other end having a facie panel attached. The door is hinged by means of conventional hinges fixed to the rear of a facia panel so that the distance between the partitions and the facias can be varied within limits. This allows a degree of on-site flexibility in the positioning of the partitions along the rear wall and in the door hanging to accommodate the fact that the lavatory installations are often positioned inaccurately.

This type of construction resulted in a somewhat crude appearance because of need for facias, and due to the positioning of the door behind the facias. The hinges required to fix the door to the facia are relatively expensive and hanging the door in this way requires a fairly skilled operation. If the door were to be self closing, then a more complicated and expensive type of hinge would be required. This type of construction was not easily adapted to allow for cubicles to be used by the disabled in wheelchairs. It is more convenient for a wheelchair user to use a toilet cubicle whose door opens outward and this type of construction does not easily lend itself to this type of modification.

More recently, a cubicle construction has been created which comprises a rear wall, a side wall, a side panel and a vertical post has a rearwardly facing elongate channel in which one vertical edge of the side panel is located. An elongated cross member which is attached to the top of the post and which extends horizontally perpendicular to the panel. In this type of construction, a door is mounted relative to the cross member, which is pivotally supported by a foot, whereby the door is pivotable about a substantially vertical axis spaced from the post at or near one side of the door. The post having an ornate vertical front flange which is abutted by the door at its other side when the door is in the open position. The foot is typically adjustable in height and the pivotal axis of the door is spaced from one side along its width. In order to make the door tend to close under its own weight, the pivotal axis could be slightly off-set from the vertical in a direction with a component which extends upwards and towards the post. Alternatively, the door may be made to tend to open by a similar movement in the opposite direction.

For the door to be pivotally adjustable, this required that the relationship of the foot to the ground be adjustable. However, the movement of the door about its axis of the foot has a tendency work the pivot out of the foot, resulting in a weakening of the door attachment. Substantially the entire weight of the door is supported by the top pivot and the foot pivot. Should the bottom pivot pin work its way too far down, the top pivot could slip out resulting in injury. Moreover, vandalism is generally a concern in the design of toilet cubicles. It is desirable to create cubicles that are resistant to tampering.

Thus, it would be desirable if the cubicle of this construction could be cared for at low cost, yet maintain a structural rigidity to prevent the doors hinges from loosening, to allow ease of installation and at a low cost.

SUMMARY OF THE INVENTION

A cubicle construction in accordance with this invention generally comprises plural upright spaced apart side panels supported along vertical edges by upright posts, and joined at the top by a lateral headrail transverse to the upright panel and posts. A door is pivotally supported between the headrail and a foot affixed to the floor. The foot has a threaded member for adjusting its relative height and thus the vertical door position. A fastener movable about the threaded member engages a surface in the foot to fix the height of the foot. The fastener has a transverse internal threaded aperture extending to the threads of the threaded member, and a set screw having a tapered end surface moveable within the threaded aperture to engage the threads of the threaded member to prevent the fixed threaded member from loosening and upward travel after the door has been in use. A gravity hinge has a first portion having a first oblique surface annularly disposed about a bottom pivot element of the door and fixedly engaged with the foot defining the nominally open positioning of the door. A second portion having an oblique surface annularly disposed about the bottom pivot element and mating with the oblique surface of the first portion is coupled to the lower portion of the door.

In a more specific example, the cap has a lower internal thread for receiving the threaded member, and the base has an upper internal thread for receiving the other end of the threaded member. The cap is fixed to the threaded member and rotates to adjust the height in the base. The fastener is a nut rotatable about the threaded member having a transverse internal thread normal to the axis of the threaded member and extending through to the threaded member. The base has an upper surface which is engaged by the nut, when the nut is fixed to the base. The further combination of the set screw destructively engaging the threads of the threaded member prevents travel of the threaded member, when in use.

BRIEF DESCRIPTION OF THE DRAWINGS

The nature of the invention described herein may be best understood and appreciated by the following description taken in connection with the accompanying drawings in which:

FIG. 1 is a perspective view of three adjacent cubicles constructed in accordance with this invention;

FIG. 7 is an exploded detail perspective view of the gravity hinge arrangement of the foot used in connection with the cubicle construction depicted in FIG. 1 in accordance with this invention; and FIG. 8 is a detail perspective view of the fastening arrangement of the foot used in connection with the cubicle construction depicted in FIG. 1 in accordance with this invention.

DETAILED DESCRIPTION

Figure 2:
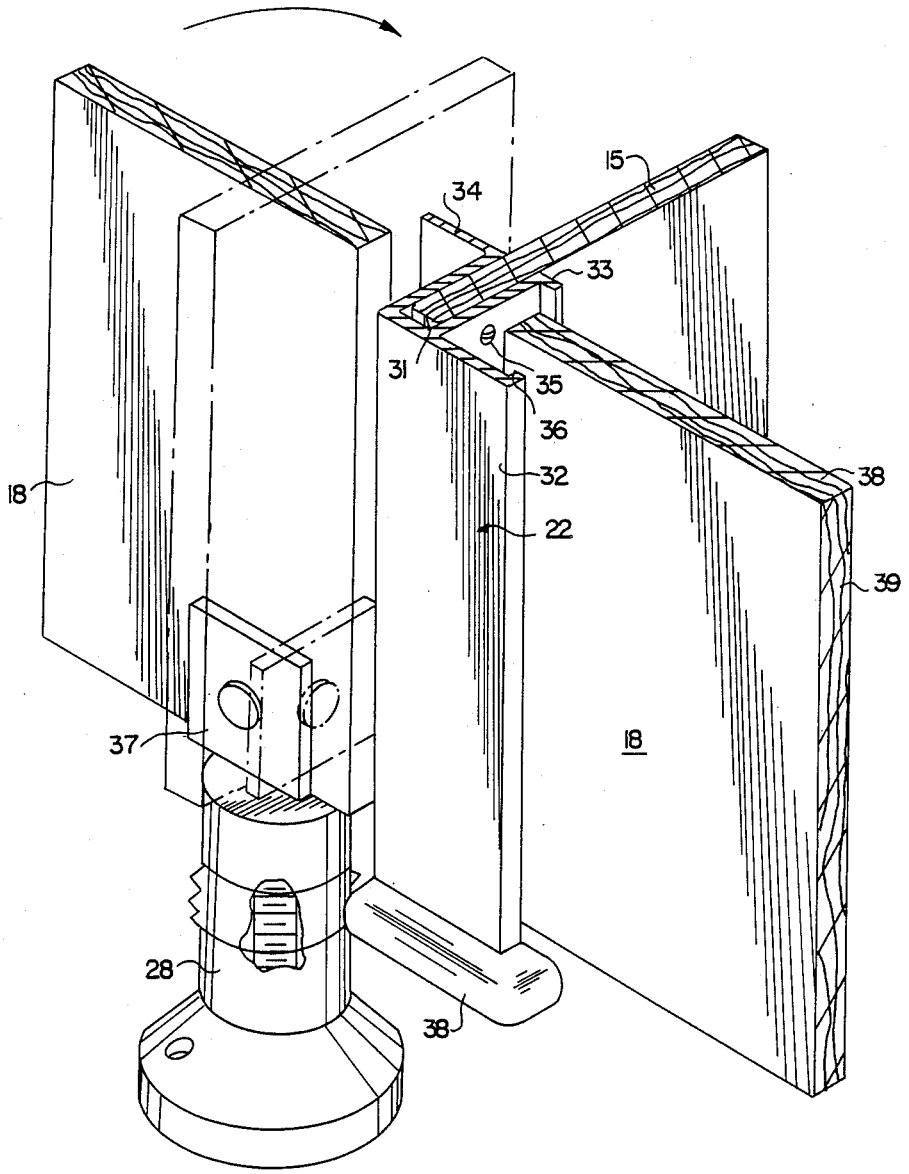
FIG. 2 is a detailed perspective view of a portion of the cubicle depicted in FIG. 1.
Figure 3:
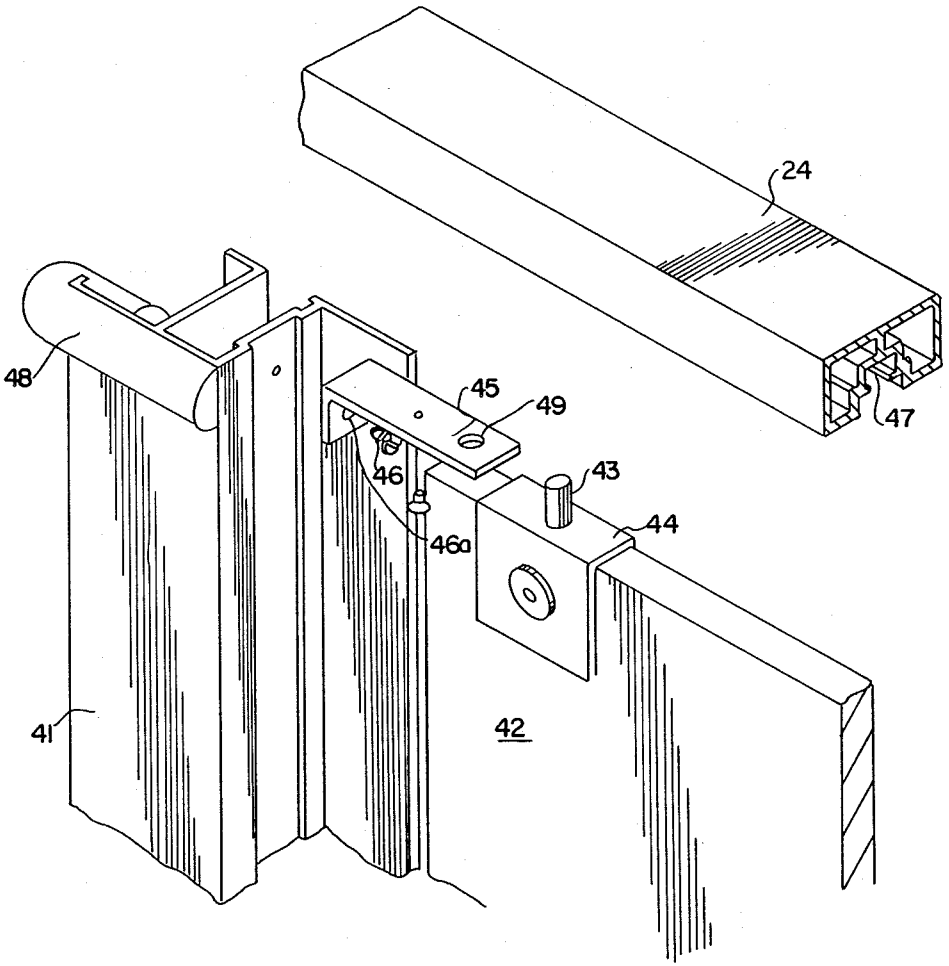
FIG. 3 is a detailed perspective view of the top pivot arrangement of a cubicle of the type used in connection with this invention.

With particular reference to FIGS. 1, 2 and 3, a toilet cubicle construction 10 in accordance with this invention comprises three adjacent cubicles 12. The space of the cubicles 12 are defined by an end upright side panel 14 and interior side panels 15 and 16. A side wall 11 and a rear wall 13 defines the remaining confines of cubicle 12.

Three upright doors 18 are disposed, when in a nominally closed position, normal to the side panels 14, 15 and 16. One door 18 extends across the space between panel 14 and 15. Another door 18 extends across the space between panel 15 and 16 and the third door 18 extends across the space between panel 16 and the side wall 11.

The panels 14, 15 and 16 are affixed to the rear wall 13 by brackets 20 affixed to the edges of the panels. Parallel spaced upright posts 21, 22 and 23 are joined to the side panels 14, 15 and 16 remote from the rear wall 13 and a laterally disposed headrail 24 joins the upper ends of the posts 21, 22 and 23. A foot 26 affixed to the floor 27 supports the side panel 14 and feet 28 affixed to the floor 27 supports the doors 18.

Referring to FIG. 2, the upright post 22 includes a rearwardly facing elongate front flange 32 running the length of the post, a first elongate rear flange 33 running the length of the post 22 and a second elongate rear flange 34 running the length of the post 22. The panel 15 located within the channel 31 by means of screws 35. The front flange 32 has a lip 36 which serves as an abutment surface for the door 18. The first rear flange 33 serves as an engagement surface for the door lock. The second rear flange 34 is located behind the door 18, overlapping its edge to block off the gap between the main portion of the post 22 and the door 18.

The doors 18 and the panels 14, 15 and 16 are made of particle board 38 or marine plywood having a fiberglass epoxy covering 39 laminated to the particle board 38 such as 0.090 thickness Duratuff brand fiberglass paneling of the type commonly used for lining trucks and freezer compartments. Fiberglass covering 39 allows rapid repair by remolding destroyed portions by placing an epoxy resin to the door 18 or panels 14. This allows the use of relatively inexpensive wall construction, yet the fiberglass permits significant protection against water and corrosive cleaning chemicals. Formica brand laminates may also be affixed to particle board for the doors 18 and panels 14.

The door 18 has a downwardly extending pivot rod 40 attached to it by means of a bracket 37. The pivot rod 40 extends into a bore 30 in the foot 28 as viewed in FIG. 5. The door 18 is thus pivotally supported by the foot 28. The door 18 is shown in its open position in broken lines in FIG. 2. As can be seen, the door 18 opens inward. A buffer 38 is located at the bottom end of the post 22.

FIG. 3 shows the assembly at the head of a post 41 which is a mirror image of the posts 21, 22 and 23. Thus, the door 18 associated with the post 21 opens inward about an axis at its left-hand side whereas the doors 18 in FIGS. 1 and 2 open inward about an axis on the right.

The door 42 has an upwardly extending pivot rod 43 attached to its upper edge by means of a bracket 44.

The headrail 24 is fixed to the post 41 by means of a right angled pivot plate 45. This pivot plate 45 has a relatively short portion which is attached to the post by means of a screw 46 and a relatively longer portion which is similarly attached to the underside of the headrail 24. The pivot plate 45 also has a pivot aperture 49 in the relatively longer portion, in which the pivot rod 43 is pivotally located. The head rail 24 has, in its under surface, an elongated channel 47 into which the pivot rod 43 extends. A top buffer 48, similar to the bottom buffer 38 is fixed to the top of the post 41. A clearance, therefore, is provided between the top edge surface of the door 18 and the rail 24 and between the pivot rod 43 and the channel 47 in order to compensate for the upward camming motion of the gravity hinge.

In practice, the upper pivot rod 43 is arranged directly above the lower pivot rod mentioned in relation to FIG. 2 to define the pivotal axis of the door.

Figure 4:
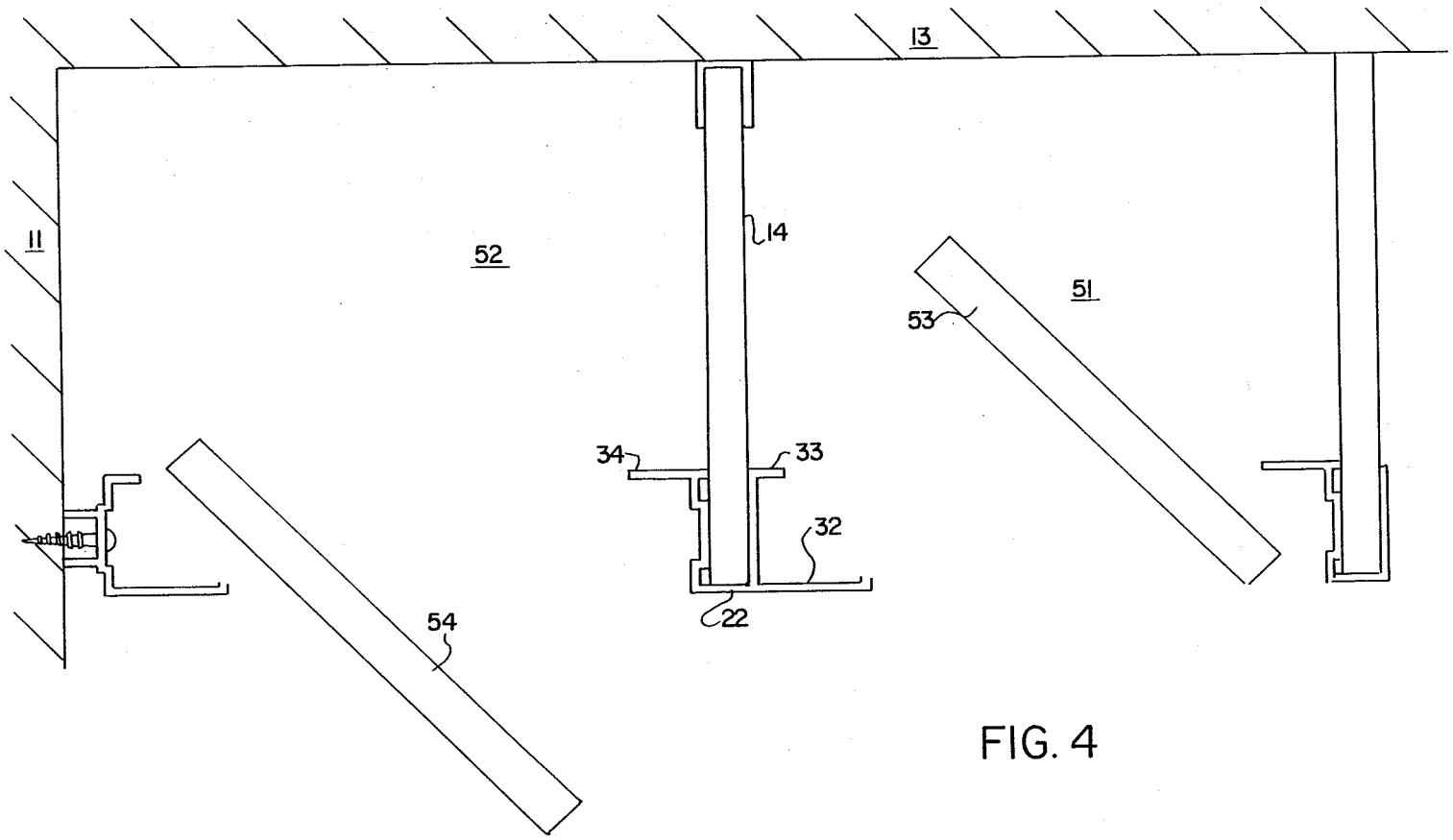
FIG. 4 is a simplified top plan view of a different example of a cubicle construction in accordance with this invention.

FIG. 4 shows two adjacent cubicles 51, 52. The cubicle designated 51 is normal in that its door 53 is arranged to open inward. The cubicle designated 52 is intended to be suitable for use by wheelchair users and so its door 54 opens outward. As can be seen in FIG. 4, the cubicle space is partly defined by the side wall 11 and the rear wall 13. Side panels 14 are affixed to the rear wall 13. Posts 22 engage and are supported by the side panels 14. The doors 53, 54 are spaced apart from the posts 22 and pivot independently. The door, 53 which opens inward, has a nominally inwardly resting position, while the door 54 which opens outward has a nominally outwardly resting position. This is provided by the arrangement of the feet 26 of the doors in combination with a gravity hinge arrangement discussed below.

With particular reference to FIGS. 1, 2 and 3, it should be understood that the panels and the doors have considerable weight. Partly to keep the doors 18 and the side panels 14, 15 and 16 apart from the floor, the panels 14, 15, 16 and doors 18 are supported by feet 26, 28. The brackets provide some support for the side panels 14, 15 and 16 from the wall, yet the feet 26, 28 must provide a substantial element of support of the cubicle construction 10. Moreover, the support for the doors is essentially provided by the lower and upper pivot rods 40, 43, the lower pivot rod 40 being supported by the feet 28. Thus it can be appreciated that a major component of weight is supported by the feet 26, 28.

Figure 5:
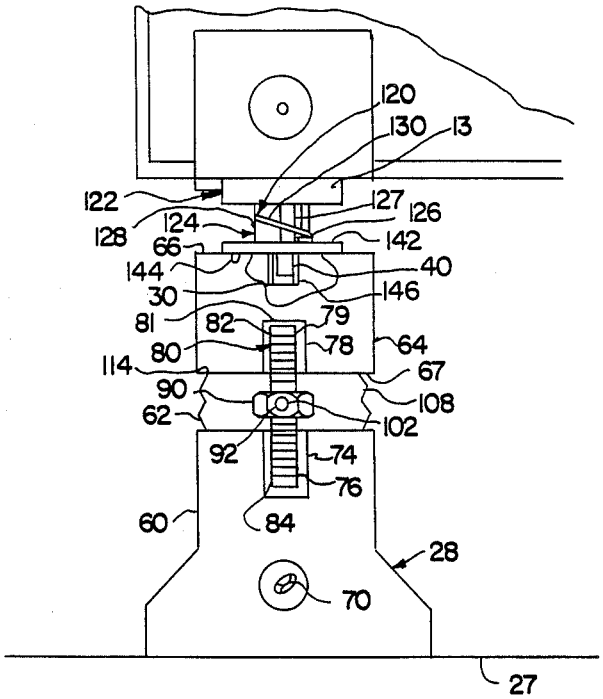
FIG. 5 is a detail elevational view of the door supporting foot of the cubicle depicted in FIG. 1 in accordance with this invention with portions exposed and portions removed.
Figure 6:
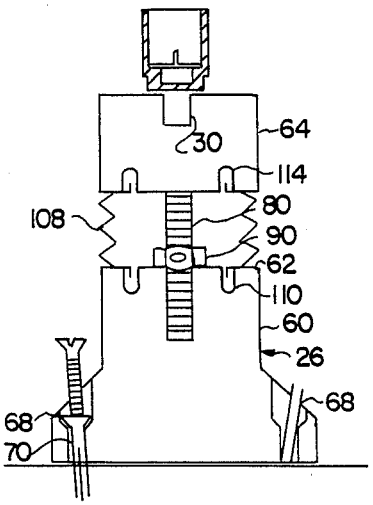
FIG. 6 is a detail elevational view with portions exposed and portions removed of a portion of a supporting foot of the cubicle depicted in FIG. 1 in accordance with this invention with portions exposed and portions removed.

With particular reference to FIG. 5, a door foot 28 is shown in greater detail. The door foot 28 comprises a foot base 60 having an upper surface 62, and a foot cap 64 having an upper surface 66 and a lower surface 67. The base 60 is mounted to the floor 27. The cap 64 provides pivotal support for the doors 17, 18 and 19 and side panels 14, 15 and 16. The base 60 has a plurality of mounting apertures 68. The mounting apertures receive molly fasteners 70 for mounting the base 60 onto the floor 30. Both the base 60 and the foot cap 64 are molded of glass filled nylon which provides strength and resistance to corrosive cleaning chemicals.

A vertically disposed brass insert 74 is mounted upright in the base 60, beneath the upper surface 62. The insert 74 has an interior thread 76 defining a central upright axis. The cap 64 also has a vertically disposed brass insert 78. The brass insert 78 has an interior thread 79 along the same central upright axis. A threaded member 80 having first and second ends 82, 84 has threads 86. The first end 82 mating with the interior threads 79 of the base brass insert 78 and the opposite or second end 84 of the threaded member 80 mates with the interior threads of the foot cap 64. The insert 78 of the cap 64 has a stop surface 81 for limiting travel of the threaded member 80.

The purpose of the threaded member 80 and the cap 64 is to allow vertical adjustment of the position of the feet 28 which support the doors 18 and the feet 26 which supports the side panels 14, 15 and 16. The level of the feet 26 must be sufficiently high to maintain the upper pivot rod 40 in its pivot bracket 44, yet allow free rotational movement. Moreover, the feet 26, 28 must allow inexpensive on-site installation of the cubicle construction.

A locking arrangement is provided for fixing the spacing of the cap 64 with respect to the base 60. A fastening nut 90 has an interior thread 92 which mates with the thread 86 of the threaded member 80. The nut 90 in generally movable along the threads 86 of the threaded member 80. The nut 90 has a fine transverse thread 94 for receiving a set screw, and a set screw 96 having a thread 98 disposed in the transverse thread 94. The set screw has a tapered point 100 at one end and an allen wrench head 102 at the other end for fastening.

Bellows 108 are disposed between the base 60 and the cap 64. An annular channel 110 is disposed on the top surface of the base 60 provides for receiving one end of the bellows 108. The opposite end of the bellows 108 is disposed between the slotted portions 114 of the cap 64. The bellows 108 cover the threaded members 80 and nut 90, provide protection from moisture and corrosive cleaning materials and enhance the appearance of the feet 26, 28.

There are two types of feet 26, 28 used in the cubicle construction 10. The feet 28 attaches to the side panels 14, 15, 16. The other foot 26 attaches to the side panel 14. The feet 28 provide for adjustable angular positioning of the door with respect to the plane defined by the upright posts 22. That positioning is established by a gravity hinge 120 attached to the foot 28 beneath the door 18 and above the foot 28. The purpose of the gravity hinge 120 is to (a) provide for adjustment of the nominally open position of the door, and (b) to prevent the pivot rod 40 from digging into the pivot bore 30 in the upper cap 64. The gravity hinge 120 includes a top portion 122 and a bottom portion 124. The bottom portion 124 has a bottom plate 125 for engaging the upper cap 64 and an aperture 126 aligned with the aperture bore 30 of the upper cap 64. The bottom portion 124 also has an upwardly extending annular portion 128 having an generally oblique truncated and gently tapered surface 130. The surface 130 extends on each side 129, concave upwardly and approximates a portion of a helix, terminating in a peak 131 at its highest point, and in an indentation 133 at its lowest point. The top portion 122 of the gravity hinge 120 has a generally planar surface 132 normal to the axis of the bore 30 and a pair of spaced apart upper rails 134 extending normal to the planar surface 132. The planar surface 132 and rails 134 define a channel for receiving the bracket 37 supporting a bottom surface of the door 18.

The upper portion 122 has an aperture 136 along a vertical axis mating with the lower pivot rod 40 of the door, and a downwardly extending annular portion 138 having an generally oblique truncated and gently tapered surface 140. The surface 138 is matable with the generally oblique truncated and gently tapered surface 130 of the lower portion 124. The surface 138 also extends on each side 137, convexly downward upwardly and approximates a portion of a helix, terminating in an indentation 139 at its highest point, and in a peak 141 at its lowest point. As the upper and lower portions 122, 124 of the gravity hinge 120 are rotated with respect to one another, the weight of the door 18 bearing on the lower pivot rod 40 causes forces to be exerted downward on the oblique mating surfaces 130, 140 of the upper and lower portions 122, 124. This tends to force the portions into mating engagement with one another.

The top of the cap 64 has four apertures 142 disposed about the central aperture bore 30. Four nubs 144 disposed on the bottom of the lower portion 122 of the gravity hinge 120 mate with the apertures 142 and fix the positioning of the bottom portion 122 with respect to the cap 64. This establishes the relationship of the nominally open door position. The gravity hinge 120 further spaces the pivot rod 40 apart from a bottom surface 146 of the bore 30 in the cap, to prevent the pivot rod 40 from digging into the cap 64.

For installation, the bracket 45 is affixed by screw 46 and screw aperture **46*a* to the post 41 as viewed in FIG. 3. The bracket 44 is slid over the top of the door 42, aligned with the pivot aperture 49. The pivot rod 43 is then placed through the aperture 49. At the bottom of the door 42, (or the doors 18 as viewed in FIG. 1), the cap 64 is threaded onto the threaded member 80 until prevented from further travel by the top inner surface 81 of the insert 78. The bottom pivot rod 40 is placed through the aperture 126 of the gravity hinge 120 and through the bore 30 of the cap 64. The nut 90 is kept at this point intermediate the cap 64 and the base 60, until proper positioning of the cap relative to the base 60. This is achieved by rotating the base 60 on the threads 86 of the threaded member 80 until the correct distance is obtained. When approximately the correct position is obtained, the base is further rotated to define the nominally open position of the door 18 as defined by the mating position of the gravity hinge 120. Thus, when the oblique surface 140 of the upper portion 124 of the gravity hinge and the oblique surface 130 of the lower portion 122 of the gravity hinge 120 are mated, the nominally open position of the door 18 is defined, and this is determined by the angular positioning of the cap 64 supporting the gravity hinge 120**.

After the vertical positioning and angular nominally open position of the door has been fixed, the nut 90 is rotated downward to engage the upper surface 62 of the base 60. The nut 90 is tightened to fix the positioning of the preadjusted portion. The set screw 92 is tightened with an allen wrench. As the set screw is rotated toward the threaded member 80, the tapered point 100 comes into engagement with the thread 86. Further tightening destructively engages the thread 86 and prevents loosening of the nut 90, and travel of the thread 80 with respect to the base 60.

Similarly for the panels 14, the foot 26 is preadjusted by rotating the cap 64 with respect to the base 60, rotating the nut 90 onto the top surface 62 of the base 60 locking in the height of the foot 26, and then fastening the set screw 92 to destructively engage the threads 86 of the threaded member 80.

It should be recognized that particularly with respect to the doors 18, the foot 28 is supporting considerable weight, and the force of the door 18 on the foot 28 is not static, but frequently subject to rotational movement and abuse. The objective is to be able to provide a door 18 that is both stable, can be adjusted in height during installation, but will not become loosened or travel upward during usage. Were that not achieved, the door 18 could become loosened, the pivot element 40 loosening from the bracket 45, possibly falling from the cubicle 10.

The preferred construction of the feet 26, 28 is to have the upper cap 64 limit travel of the threaded member 80 so that height adjustment is made by rotating the cap 64 carrying the threaded member 80, and then fixing the height adjustment by engaging the nut 90 against the top surface 62 of the base 60. However, it is also possible to construct a foot which engages the thread and rotates with the thread into the cap 64 to achieve the proper height adjustment, which could be fixed by fixing the nut 90 against the lower surface of the cap 64.

Thus, a cubicle has been described of the type suitable for toilet or dressing room installations, which allows adjustable, simple and inexpensive installation while maintaining attractive features.

While the invention has been described with reference to specific forms thereof, it will be understood that changes and modifications maybe made within the spirit and scope of this invention.

What is claimed is:

1. A cubicle construction comprising:

an upright rear planar means for supporting edges of normally disposed upright panel means;

plural spaced apart planar side means for defining sides of a cubicle, the side means coupled to the upright rear planar means;

vertical post means for engaging the plural spaced apart planar panels means, the vertical post means defining an upper portion;

elongated headrail means for structurally engaging the post means, the elongated headrail means coupled at the upper portion of the post means, extending normal to the planes of the side means;

door means pivotally mounted about an axis adjacent, parallel and spaced apart from the vertical post means, the door means comprising upper pivot means for pivotally coupling the door to the cubicle at an upper portion of the door, and downwardly extending pivot means for pivotally coupling the door at the lower portion of the door; and foot means for pivotally supporting the door means, the foot means having an adjustable length; the foot means characterized by threaded means for adjusting the length of the foot means, the threaded means coupled to the foot means;

first fastener means for fixing the length adjustment of the foot means, the first fastener means coupled to the threaded means; and second fastener means coupled to the first fastener means for engaging the threaded means to thereby prevent further adjustment of the length of the foot means despite rotation of the door means about the pivot.

2. The invention as set forth in claim 1 and in which the foot means comprising:

cap means for receiving the pivot member of the door means in pivotal relationship;

base means for affixing the foot means to a floor;

the threaded means coupling the cap means to the base means;

the fastener means threadably mounted on the threaded means, the fastener means comprising a set screw;

the base means defining an upper surface for engaging the fastener means in fixed relationship, the fastener means having a an aperture disposed transverse to the axis of the threaded means, the set screw disposed within the transverse aperture and engagable with the threaded means to destructively engage the threads of the threaded means and thereby prevent travel of the threaded means with respect to the base means.

3. The invention as set forth in claim 2 and comprising gravity hinge means for establishing a nominally open position of the door in relationship to the plane defined by the post means, the gravity hinge means coupled intermediate the foot means and the door means.

4. The invention as set forth in claim 3 and in which the gravity hinge means comprises an upper means for engaging the door means and lower means for engaging the foot means, the upper and lower means having an alignable aperture extending through both the upper means and the lower means for receiving a lower pivot member from the door means, the lower means having a an upwardly extending annular portion having an generally oblique truncated surface disposed about the alignable aperture, and the upper means having a downwardly extending annular portion having an generally oblique truncated surface disposed about the alignable aperture matable with the oblique surface of the lower means when the door means rests in a mated position, whereby the nominally closed position of the door is established by the position of the door means when the gravity hinge is in a mated position.

5. The invention as set forth in claim 1 and in which the foot means comprising:

a base having means for fixing the base to the floor, the base having an upper surface;

the threaded means extending upwardly vertically from the base unit defining a vertical axis;

cap means for supporting the lower pivot means of the door means, the cap means having a upper means for receiving the lower pivot means of the door, and lower means for coupling the cap means to the threaded means;

the threaded means rotatable to adjust the spacing between the cap means and the base means, and thereby adjust the height of the foot means;

the first fastener means comprising a nut having an internal thread mating with the threaded means, the nut movable to a position engaging the upper surface of the base;

the nut having an internal threaded aperture along an axis transverse to the vertical axis of the threaded means;

set screw means having a thread mating with the internal threaded aperture of the nut means, the set screw movable within the nut means and fastenable to reach and engage the threads of the threaded means, and whereby the nut moveable to the upper surface of the base thereby fixing the positioning of the height of the door, so that the upper and lower pivot means of the door means and are in proper engagement, the set screw movable then to forcibly invade and destructively engage the screw threads of the threaded portion and tightly fix the position, and to thereby prevent travel of the threaded portion despite movement of the door means and the upper and lower pivot means.

6. The invention as set forth in claim 5 and in comprising threaded insert means disposed within the molded portion for receiving the threaded member, the threaded insert means mating with the threaded member whereby the threaded member can be adjustably rotated into desired position in the insert means, and the nut means can be rotated to engage the upper surface of the base portion to fix the position of the upper pivot bearing surface.

7. The invention as set forth in claim 6 and comprising:

means for fastening the base to a floor; and bellows extending between the cap and the base for adjustably covering the threaded member and the fastening means, thereby protecting the threaded means from corrosive cleaning materials; and a threaded insert disposed in the bottom portion of the upper cap of the foot means, the threaded insert mating with the upper portion of the threaded member whereby the threaded member can be adjustably rotated into desired position in the insert means to locking engagement.

8. The invention as set forth in claim 6 and comprising means for limiting travel of the threaded member in the cap, and in which the threaded member is adjustably movable in the base to adjust the height of the foot means, whereby the nut is tightened and fixed at the top surface of the base.

9. The invention as set forth in claim 8 and comprising bellows means surrounding the threaded portion to protect the threaded portion and in which the mold comprises glass filled nylon and the door means comprises a laminated fiberglass covering.

10. The invention as set forth in claim 6 and in which the cap defines a pivot base for receiving the bottom pivot means of the door means, and comprising a gravity hinge means for defining a nominally open door position and limiting travel of the lower pivot means in the bore.

11. The invention as set forth in claim 10 and in which the gravity hinge means comprises bottom means for engaging the upper cap, the bottom means having a aperture therethrough mating with the aperture of the upper cap, and a an upwardly extending annular portion having an generally oblique truncated surface.

12. The invention as set forth in claim 11 and in which the upper portion of the gravity hinge comprises means for engaging the bottom surface of the door, the upper means having a aperture therethrough mating with the lower pivot rod of the door, and a an downwardly extending annular portion having an generally oblique truncated surface matable with the generally oblique truncated surface of the lower portion, whereby as the upper and lower portions of the gravity hinge are rotated with respect to one another, the weight of the door bearing on the lower pivot rod causes forces to be exerted downward on the oblique mating surfaces of the upper and lower portions, thus tending to force the portions into mating engagement with one another.

13. The invention as set forth in claim 9 and in which the upper portion comprises a generally planar surface normal to the aperture axis and a pair of spaced apart upper rails extending normal to the planar surface, the planar surface and rails defining a channel for receiving a bottom surface of the door.

14. A cubicle construction comprising:

plural spaced apart planar panels means comprising an upright rear planar panel means for supporting edges of normally disposed upright panel means; and at least one side panel for defining a side of the cubicle, the side panel coupled to the upright rear planar panel means;

vertical post means for engaging the plural spaced apart planar panels means, the vertical post means defining an upper portion and a lower portion;

elongated headrail means for structurally engaging the post means, the elongated headrail means coupled at the upper portion of the post means, extending normal to the plane of the side panel;

a door pivotally mounted about an axis adjacent, parallel and spaced apart from the vertical post means, the door comprising an upper pivot for pivotally coupling the door to the cubicle at an upper portion of the door, and downwardly extending pivot means for pivotally coupling the door at the lower portion of the door; and foot means for pivotally supporting the door, the foot means having an adjustable length; the foot means comprising a cap means for receiving the upper pivot of the door in pivotal relationship;

base means for affixing the foot means to a floor;

fastener means comprising a threaded member adjustably coupling the cap means to the base means; and a nut threadably mounted on the threaded member;

the base means defining an upper surface for engaging the fastener means in fixed relationship, the nut having a an aperture disposed transverse to the axis of the threaded means, and a set screw disposed within the transverse aperture and engagable with the threaded member to destructively engage the threads of the threaded member and thereby prevent travel of the threaded member means with respect to the foot means; and gravity hinge means for establishing a nominally open position of the door in relationship to the plane defined by the post means, the gravity hinge means coupled intermediate the foot means, the gravity hinge means comprises an upper means for engaging the door means and lower means for engaging the foot means, the upper and lower means having an alignable aperture extending through both the upper means and the lower means for receiving the downwardly extending pivot means from the door, the downwardly extending pivot means having a an upwardly extending annular portion having an generally oblique truncated surface disposed about the alignable aperture, and the upper means having a downwardly extending annular portion having an generally oblique truncated surface disposed about the alignable aperture matable with the oblique surface of the lower means when the door means rests in a mated position, whereby the nominally closed position of the door is established by the position of the door means when the gravity hinge is in a mated position.

15. The invention as set forth in claim 14 and in which the foot means comprising:

comprising threaded insert means disposed within the cap for receiving the threaded member, the threaded insert means mating with the threaded member and having means to limit travel of the threaded member in the cap beyond a fixed distance, whereby after the threaded member is fully seated in the cap, the threaded member can be adjustably rotated into desired position in the base, and the nut means can be rotated to engage the upper surface of the base portion to fix the position of the upper pivot bearing surface.

16. An adjustable door support arrangement for a cubicle of the type comprising a planar upright door and a pivot extending downwardly from the door, the support arrangement comprising:

base element including means for coupling the base element to a floor, the base element including an internal thread disposed upright in the base element;

a cap portion having a centrally disposed internal thread disposed upright, an upper portion disposed above the internal thread and a door pivot receiving bore positioned in the upper portion of the cap portion for receiving the pivot of the upright door;

a threaded member coupled to the internal thread of the base element and the cap portion, the cap and base element rotatable about the threaded member to adjust the height of the support;

an engagement surface for engaging a fastener, disposed on the support arrangement;

a fastener disposed on the threaded member and moveable to engage the engagement surface and fix the adjustment height of the support; and a transversely disposed set screw means for engaging the threaded member and preventing travel of the fastener, the set screw means disposed within the fastener.

17. The invention as set forth in claim 16 and comprising:

a gravity hinge coupled to the cap, the gravity hinge comprising a lower portion having means for fixing the lower portion to the cap, the lower portion comprising an upright extending annular portion defining an aperture coaxial with the bore for receiving a pivot rod from a cubicle door;

an upper portion having means an upright extending annular portion defining an aperture coaxial with the bore for receiving a pivot member a cubicle door, the upper portion having a generally oblique truncated and gently tapered surface;

the lower portion having a generally oblique truncated and gently tapered surface matable with the generally oblique truncated and gently tapered surface of the lower portion, whereby as the upper and lower portions of the gravity hinge are rotated with respect to one another, the weight of the door bearing on the lower pivot rod causes forces to be exerted downward on the oblique mating surfaces of the upper and lower portions, thus tending to force the portions into mating engagement with one another.

* * * * *